US007825791B2

(12) United States Patent
Kim et al.

(10) Patent No.: US 7,825,791 B2
(45) Date of Patent: Nov. 2, 2010

(54) DISTRIBUTIONAL ALERT SYSTEM FOR DISASTER PREVENTION UTILIZING UBIQUITOUS SENSOR NETWORK

(75) Inventors: Se-Han Kim, Daejon (KR); Yoon-Mee Doh, Daejon (KR); Cheol-Sig Pyo, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 673 days.

(21) Appl. No.: 11/595,456

(22) Filed: Nov. 9, 2006

(65) Prior Publication Data

US 2007/0103298 A1 May 10, 2007

(30) Foreign Application Priority Data

Nov. 9, 2005 (KR) ..... 10-2005-0107045
Jun. 30, 2006 (KR) ..... 10-2006-0061223

(51) Int. Cl.
*G08B 23/00* (2006.01)
*G08B 1/08* (2006.01)
*G08B 9/00* (2006.01)

(52) U.S. Cl. ..... 340/500; 340/539.26; 340/286.02

(58) Field of Classification Search ..... 340/500–506, 340/539.22, 539.26, 531, 539.29, 286.02; 702/2, 3

See application file for complete search history.

(56) References Cited

U.S. PATENT DOCUMENTS 6,646,564 B1 * 11/2003 Azieres et al. ..... 340/679
6,914,525 B2 7/2005 Rao et al. ..... 340/531
7,119,676 B1 * 10/2006 Silverstrim et al. ..... 340/531
7,129,848 B2 * 10/2006 Milliot et al. ..... 340/628
7,250,855 B2 * 7/2007 Suenbuel et al. ..... 340/511
7,630,336 B2 * 12/2009 Ganesh ..... 370/328
7,694,115 B1 * 4/2010 Porras et al. ..... 713/1
2007/0090945 A1 * 4/2007 Hoogenboom ..... 340/539.1

FOREIGN PATENT DOCUMENTS

KR 1020020005241 1/2002
KR 200333763 11/2003
KR 1020050038068 4/2005
KR 1020050061938 6/2005
KR 1020050068709 7/2005

OTHER PUBLICATIONS

KIPO Notice of Patent Grant dated Apr. 14, 2008 for the corresponding application KR 10-2006-0061223.

* cited by examiner

*Primary Examiner*—Jennifer Mehmood
(74) *Attorney, Agent, or Firm*—Ladas & Parry LLP

(57) ABSTRACT

Provided is a distributional alert system using a ubiquitous sensor network (USN). When a disaster occurs, the distributional alert system detects it in a sensor node, informs the area where the disaster occurs of danger through an actuator, such as siren, or informs a management system of the danger through a wired/wireless network. The distributional alert system includes: a first sensor node for generating sense data by sensing surroundings with a sensor therein, determining whether a disaster occurs by analyzing the sense data, and creating and transmitting emergency data based on the determination result, while forming a sensor network; and an alerting node for receiving emergency data from the first sensor node on the sensor network, and outputting disaster circumstantial information to a sensor field of the sensor network upon receipt of the emergency data.

15 Claims, 5 Drawing Sheets

DISTRIBUTIONAL ALERT SYSTEM FOR DISASTER PREVENTION UTILIZING UBIQUITOUS SENSOR NETWORK

FIELD OF THE INVENTION

The present invention relates to a distributional alert system using a ubiquitous sensor network (USN); and, more particularly, to an alert system which informs a disastrous area of a danger through an actuator such as siren by sensing disastrous circumstances such as fire, flood and earthquake in sensor nodes of a ubiquitous sensor network or reports the danger to an administrator through a wired/wireless network.

DESCRIPTION OF RELATED ART

A ubiquitous sensor network (USN) is a wireless network formed of sensor nodes equipped with a sensor for sensing the identification of an object and information on surroundings. The ubiquitous sensor network processes and manages data inputted from the sensors in real-time in connection with another system. Ultimately, the ubiquitous sensor network aims to realization of an environment where all objects can be communicated anytime anywhere regardless of the kind of a network, the kind of a device and/or the kind of a service by giving computing and communication functions to all objects.

FIG. 1 shows a general ubiquitous sensor network. The ubiquitous sensor network includes sensor nodes 10, sensor fields 20 each of which is a set of sensor nodes 10, sync nodes 30 for receiving data collected in the sensor fields 20, and a gateway 40. Each sensor node is provided with a sensor for sensing identification information of an object or surroundings information in real-time and a communication module. The gateway 40 routes the data transmitted from the sync nodes 30 and transmits the data to a management server 50 through a wideband communication network. The sync nodes 30 may be connected to the gateway 40 through a conventional infrastructure, such as a satellite communication, wireless Local Area Network (LAN), Bluetooth, and wired Internet.

The ubiquitous sensor network may be used to sense occurrence of a disaster and cope with the disaster, when disaster such as fire, flood and earthquake occurs. However, since data are concentrically processed in the management server in the conventional ubiquitous sensor network, there is a problem that the reliability, immediacy, and efficiency in processing and managing data related to disaster are low.

SUMMARY OF THE INVENTION

It is, therefore, an object of the present invention to provide a distributional alert system which informs a disastrous area of a danger through an actuator such as siren by sensing disastrous circumstances such as fire, flood and earthquake in sensor nodes of a ubiquitous sensor network (USN) or reports the danger to an administration system through a wired/wireless network.

It is another object of the present invention to provide a distributional alert system which makes a decision on dangerous factor sensing information not in a central management system but directly in a sensor node that forms a ubiquitous sensor network, when the sensor node detects dangerous factors.

Other objects and advantages of the present invention will be understood by the following description and become apparent by the description of embodiments. Also, those skilled in the art to which the present invention pertains easily understand that the objects and advantages of the present invention can be realized by the means as claimed and combinations thereof.

In accordance with an aspect of the present invention, there is provided a distributional alert system using a ubiquitous sensor network, which includes: a first sensor node for generating sense data by sensing surroundings with a sensor therein, determining whether a disaster occurs by analyzing the sense data, and creating and transmitting emergency data based on the determination result, while forming a sensor network; and an alerting node for receiving emergency data from the first sensor node on the sensor network, and outputting disaster circumstantial information to a sensor field of the sensor network upon receipt of the emergency data.

In accordance with another aspect of the present invention, there is provided a distributional alert system using a ubiquitous sensor network, which includes: a plurality of sensor nodes for sensing surroundings with a sensor therein, creating and transmitting sense data, and forming a sensor network; and an alerting node for receiving the sense data from the sensor nodes, determining whether a disaster occurs by analyzing and processing the received sense data, and when a disaster occurs, outputting disaster circumstantial information.

In accordance with another aspect of the present invention, there is provided a distributional alert system using a ubiquitous sensor network, which includes: a first sensor node for generating and transmitting sense data by sensing surroundings with a sensor therein; and a second sensor node for forming a sensor network together with the first sensor node, receiving the sense data, determining whether a disaster occurs by analyzing the sense data, and creating and transmitting emergency data; and an alerting node for receiving the emergency data, and outputting disaster circumstantial information to a sensor field of the sensor network upon receipt of the emergency data.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Figure 1:
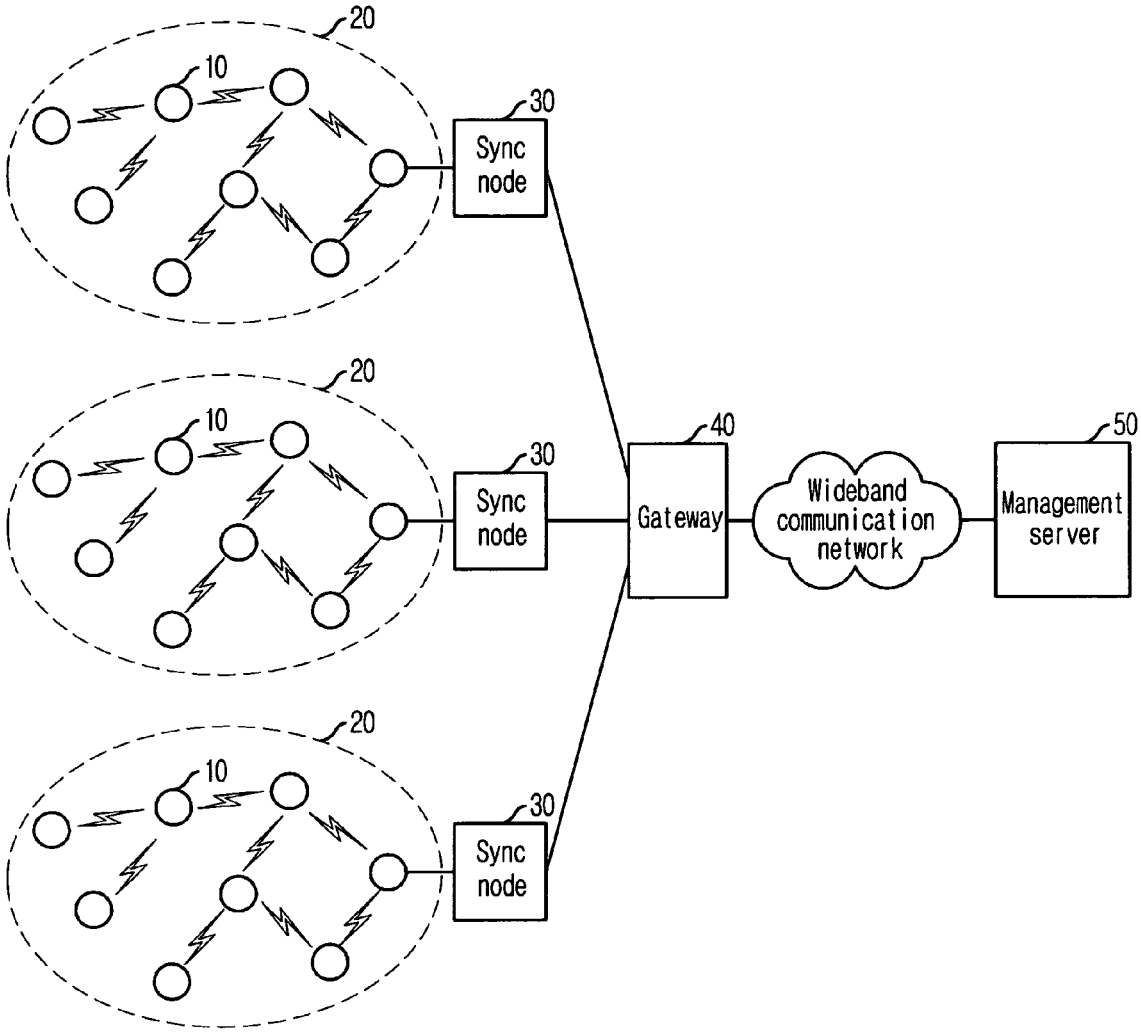
FIG. 1 (RELATED ART)
FIG. 1 is a view showing a general ubiquitous sensor network (USN)

Following description exemplifies only the principles of the present invention. Even if they are not described or illustrated clearly in the present specification, one of ordinary skill in the art can embody the principles of the present invention and invent various apparatuses within the concept and scope of the present invention.

The use of the conditional terms and embodiments presented in the present specification is intended only to make the concept of the present invention understood, and they are not limited to the embodiments and conditions mentioned in the specification.

In addition, all the detailed description on the principles, viewpoints and embodiments and particular embodiments of the present invention should be understood to include structural and functional equivalents to them. The equivalents include not only currently known equivalents but also those to be developed in future, that is, all devices invented to perform the same function, regardless of their structures.

Functions of various devices illustrated in the drawings including a functional block expressed as a processor or a similar concept can be provided not only by using hardware dedicated to the functions, but also by using hardware capable of running proper software for the functions. When a function is provided by a processor, the function may be provided by a single dedicated processor, single shared processor, or a plurality of individual processors, part of which can be shared.

The apparent use of a term, 'processor', 'control' or similar concept, should not be understood to exclusively refer to a piece of hardware capable of running software, but should be understood to include a digital signal processor (DSP), hardware, and ROM, RAM and non-volatile memory for storing software, implicatively. Other known and commonly used hardware may be included therein, too.

Other objects and aspects of the invention will become apparent from the following description of the embodiments with reference to the accompanying drawings, which is set forth hereinafter. When it is considered that detailed description on a related art may obscure the points of the present invention, the description will not be provided herein. Hereinafter, preferred embodiments of the present invention will be described in detail with reference to the accompanying drawing.

Figure 2:
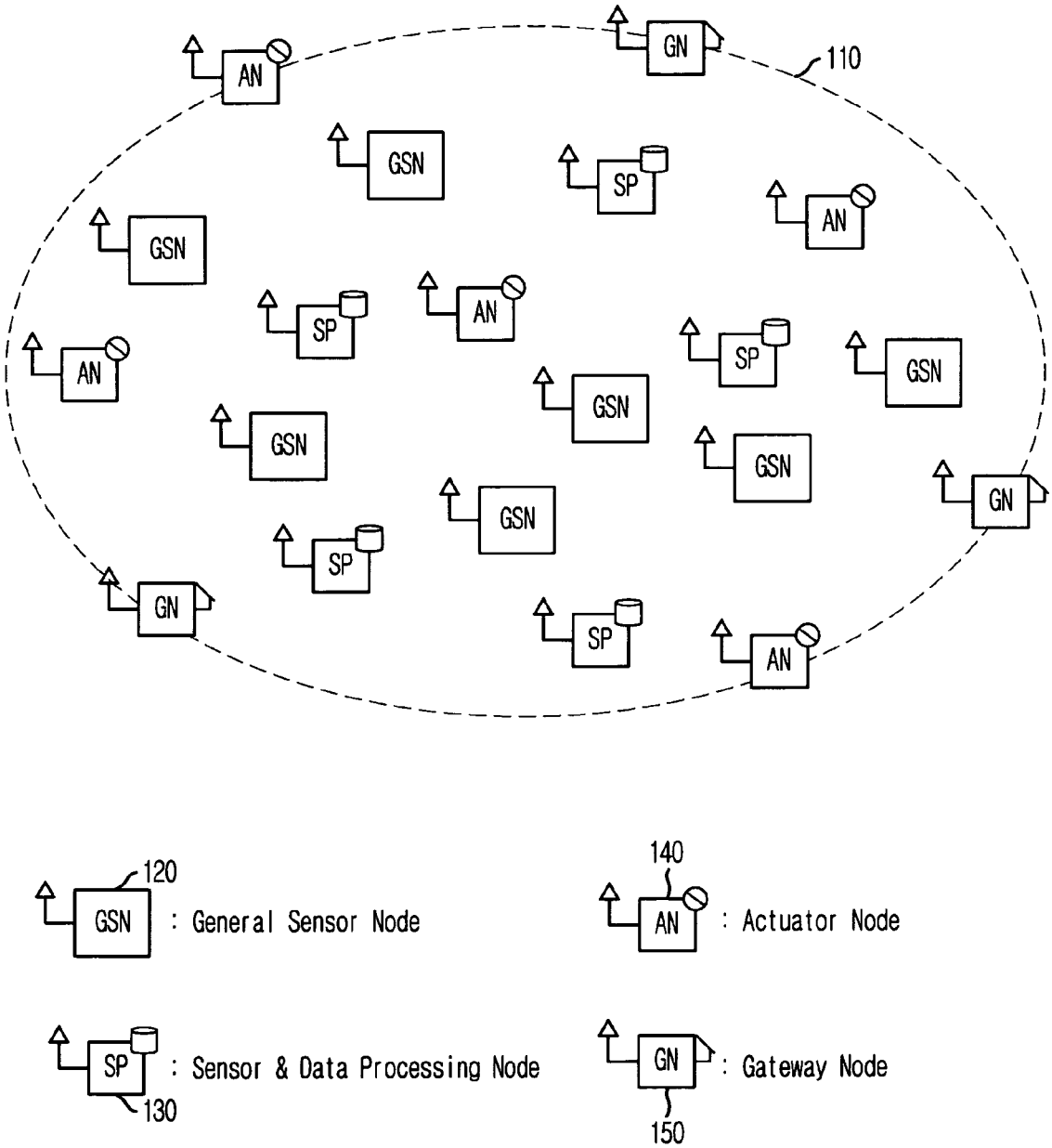
FIG. 2 is a view illustrating a distributional alert system using a ubiquitous sensor network in accordance with an embodiment of the present invention.

FIG. 2 is a view illustrating a distributional alert system using a ubiquitous sensor network in accordance with an embodiment of the present invention.

Referring to FIG. 2, the distributional alert system using a ubiquitous sensor network includes wired/wireless network nodes 120, 130, 140 and 150 distributed in a sensor field 110.

A sensor field 110 is a region where the sensor nodes 120 and 130 are distributionally set up to thereby form a sensor network in a dangerous area where diverse kinds of disasters may occur. Examples of the dangerous area include a flood dangerous area, a bank destruction dangerous area, a landslide dangerous area, and a construction site. The network nodes 120, 130, 140 and 150 set up in the sensor field 110 communicate with each other wirelessly.

The network nodes set up in the sensor field 110 include the sensor nodes 120 and 130, an actuator node (AN) 140, and a gateway node (GN) 205. The sensor nodes are classified into general sensor nodes (GSN) 120 and sensor and data processing nodes (SP) 130.

The general sensor nodes 120 sense factors that fit to the utility purpose of the sensor field 110, such as temperature, flux, atmosphere, magnetism and vibration, and transmit significant sense data that go over a predetermined threshold value among sense data to adjacent network nodes.

The sensor and data processing node 130 not only performs the sensing function but also determines whether a disaster occurs by analyzing the sense data transmitted from the adjacent general sensor nodes. When it is determined that the current situation is disastrous and emergency, the sensor and data processing node 130 creates and transmits disaster occurrence information. To be specific, the sensor and data processing node 130 determines whether the sense data it has sensed or received exceed a predetermined threshold. When the sense data exceed the predetermined threshold, it creases emergency data including disaster circumstantial information and transmits the emergency data to an actuator node 140 and a gateway node 150.

The actuator node 140 receives the disaster occurrence information from the sensor and data processing node 130 and announces the occurrence of a disaster through an altering apparatus, such as siren.

The gateway node 150 is connected to an external wired/wireless communication network and transmits/receives the sense data and the disaster occurrence information to/from the external wired/wireless communication network.

Figure 3:
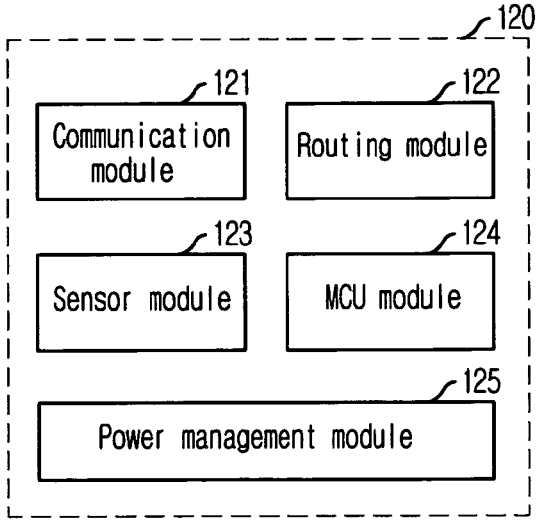
FIG. 3 is a block view showing a general sensor node (GSN) in accordance with an embodiment of the present invention.

FIG. 3 is a block view showing a general sensor node 120 in accordance with an embodiment of the present invention.

As illustrated in FIG. 3, the general sensor node 120 includes a communication module 121, a routing module 122, a sensor module 123, a micro control unit (MCU) module 124, and a power management module 125. The general sensor node 120 collects data through sensors and transmits significant data among the collected sense data to its adjacent general sensor nodes 120 or the sensor and data processing node 130.

The communication module 121 wirelessly communicates with adjacent network nodes and it includes a radio frequency (RF) processor, a modem, and a media access controller (MAC). The routing module 122 searches locations of other adjacent network nodes and sets up a communication route. The sensor module 123 includes a sensor suitable for circumstances of a dangerous area and a sensor controller for converting the physical dimensions measured in the sensor into digital signals and controlling the sensor. The power management module 125 provides and controls a power source. The MCU module 124 generally controls the above constituent elements and it includes a memory for storing and managing diverse data.

Figure 4:
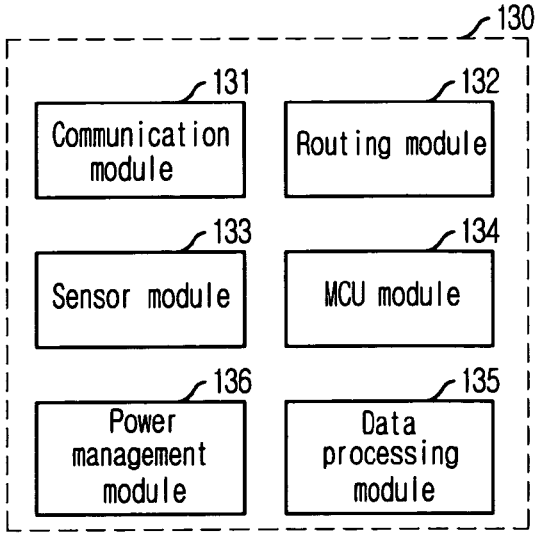
FIG. 4 is a block view showing a sensor and data processing node (SP) in accordance with an embodiment of the present invention.

FIG. 4 is a block view showing a sensor and data processing node 130 in accordance with an embodiment of the present invention.

As illustrated in FIG. 4, the sensor and data processing node 130 includes a communication module 131, a routing module 132, a sensor module 133, an MCU module 134, a data processing module 135, and a power management module 136. The communication module 131 includes an RF processor, a modem, and a MAC to wirelessly communicate with adjacent network nodes. The routing module 132 searches locations of the adjacent network nodes and sets up a communication route. The sensor module 133 includes a sensor suitable for circumstances of a disastrous area and a sensor controller for converting physical dimensions measured in the sensor into digital signals and controls the sensor. The power management module 136 provides and controls a power source.

The data processing module 135 determines whether a disaster occurs or not by processing sense data or data transmitted from an adjacent general sensor node. The MCU module 134 generally controls the above constituent elements.

The sensor and data processing node 130 analyzes and processes sense data it has collected from its own sensor or sense data it has received from an adjacent general sensor node, and when a disaster occurs, it creates emergency data and transmits the emergency data to adjacent actuator nodes 140 or gateway nodes 150.

Figure 5:
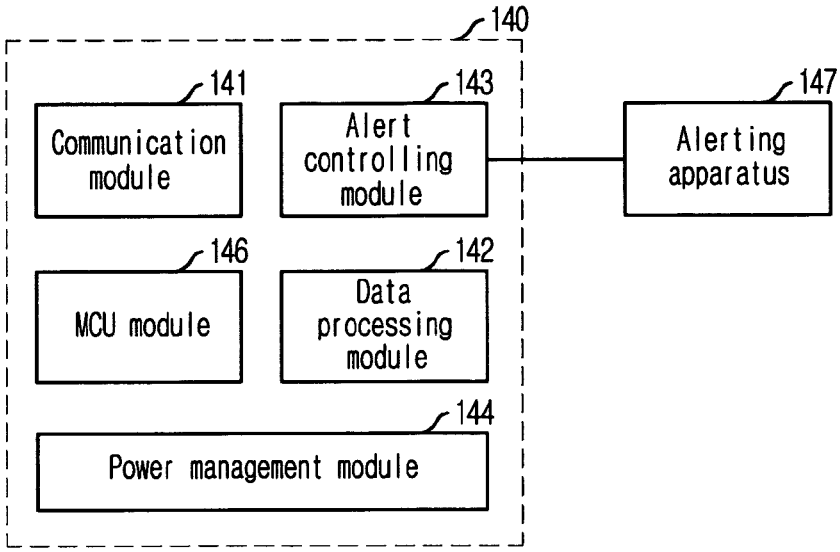
FIG. 5 is a block view showing an actuator node (AN) in accordance with an embodiment of the present invention.

FIG. 5 is a block view showing an actuator node 140 in accordance with an embodiment of the present invention. As shown in FIG. 5, the actuator node 140 includes a communication module 141, a data processing module 142, an alert controlling module 143, a power management module 144, and an MCU module 146. The communication module 141 includes an RF processor, a modem, and a MAC to wirelessly communicate with adjacent network nodes. The data processing module 142 finally determines whether to announce alert or not by processing received emergency data and outputs an alert signal. The alert controlling module 143 receives the alert signal and actuates and controls an alerting apparatus 147 such as siren. The power management module 144 provides and controls a power source. The MCU module 146 generally controls the above constituent elements. The alerting apparatus 147 may included in the actuator node 140 or it may be provided additionally in the outside.

The actuator node basically analyzes and processes the received emergency data and finally informs the dangerous area of a danger. If necessary, the data processing module 142 of the actuator node 140 can directly determine whether a disaster occurs by analyzing and processing the received sense data for itself and output an alert signal.

Figure 6:
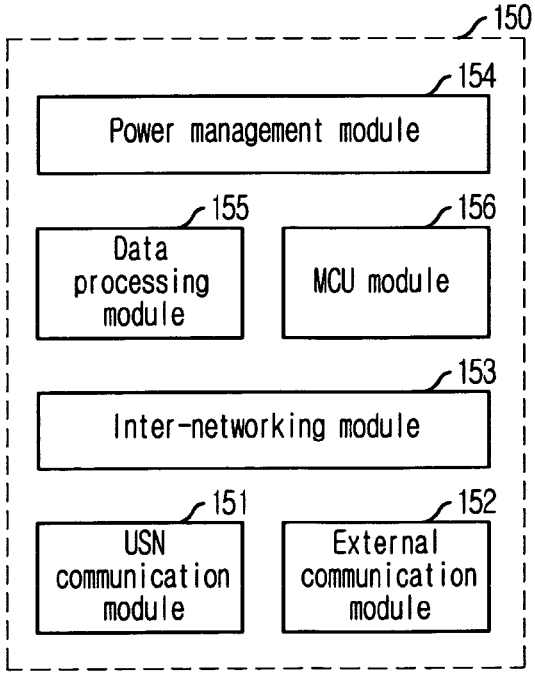
FIG. 6 is a block view showing a gateway node (GN) in accordance with an embodiment of the present invention.

FIG. 6 is a block view showing a gateway node 150 in accordance with an embodiment of the present invention. As illustrated in FIG. 6, the gateway node 150 includes a ubiquitous sensor network communication module 151, an external communication module 152, an inter-networking module 153, a power management module 154, a data processing module 155, and an MCU module 157. The USN communication module 151 includes an RF processor, a modem, and a MAC to wirelessly communicate with adjacent network nodes on a sensor network, that is, within a sensor field 110. The external communication module 152 is composed of diverse communication modules, such as Code Division Multiple Access (CDMA), Global System for Mobile communication (GSM), Wideband Local Area Network (WLAN), a modem, and Ethernet, and basic service modules for Short Message Service (SMS) and Multimedia Messaging System (MMS). The inter-networking module 153 links the USN communication module 151 with the external communication module 152. The power management module 154 provides and controls a power source. The data processing module 155 processes data transmitted from the general sensor node 120 or the sensor and data processing node 130. The MCU module 157 generally controls the above constituent elements.

The gateway node 150 informs an external management server, an administrator, or a user of disaster circumstantial information transmitted from the sensor field 110 set up in a disastrous area through diverse application networks.

Figure 7:
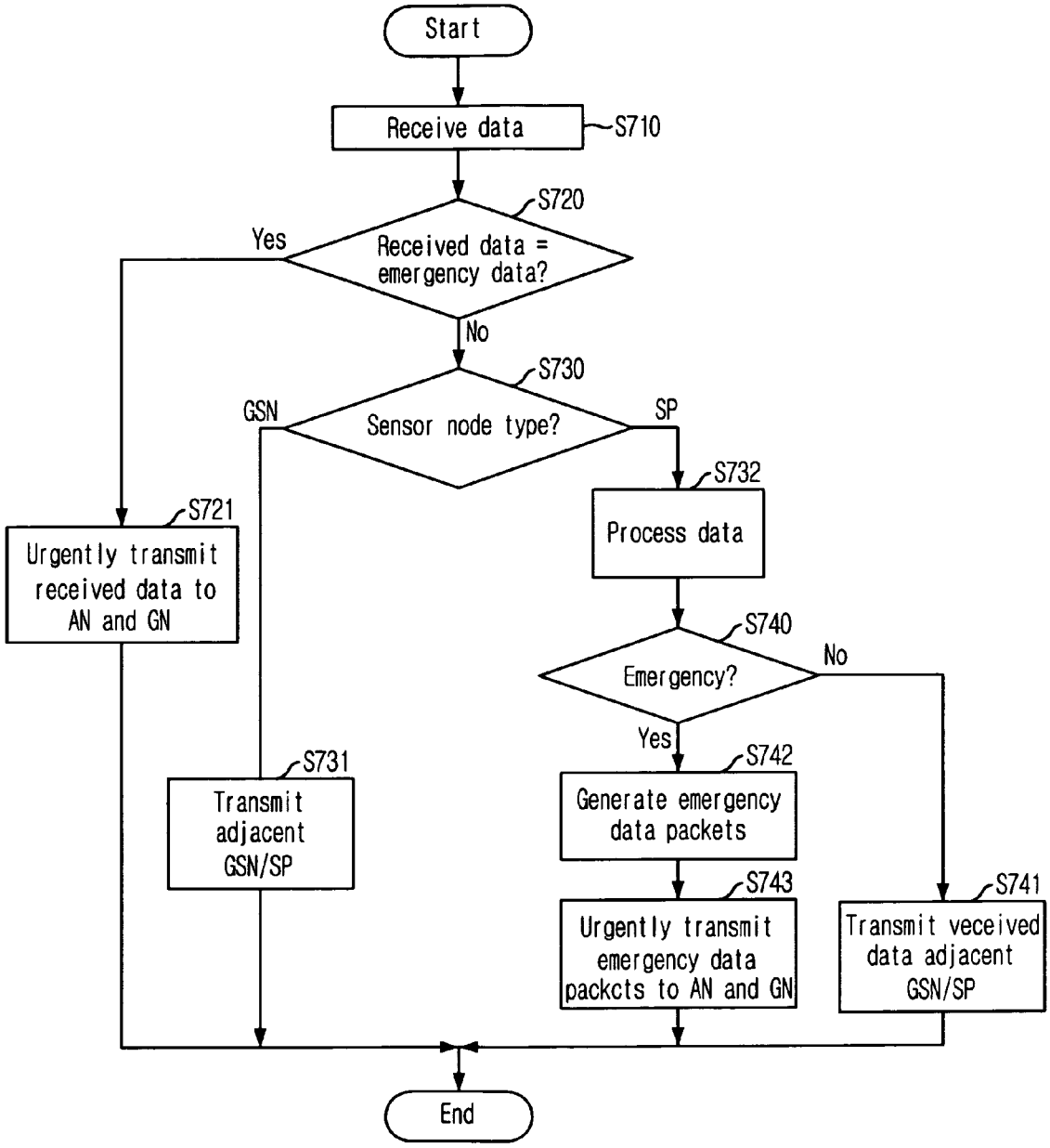
FIG. 7 is a flowchart describing a data processing in the general sensor node and the sensor and data processing node in accordance with an embodiment of the present invention.

FIG. 7 is a flowchart describing data processing in the general sensor node 120 and the sensor and data processing node 130 in accordance with an embodiment of the present invention. It presents an algorithm for processing received data and detecting a danger in the general sensor node 120 or the sensor and data processing node 130, i.e., a sensor node.

At step S710, a sensor node, i.e., a general sensor node 120 or a sensor and data processing node 130, receives data and, at step S720, the sensor node determines whether the received data are emergency data.

When the received data are emergency data, at step S721, the sensor node urgently transmits the emergency data to actuator nodes and/or gateway nodes directly or through an adjacent general sensor node 120 or an adjacent sensor and data processing node 130.

When the received data are not emergency data, at step S730, the type of the sensor node which has received the emergency data is determined to decide the subsequent data processing procedure.

When the type of the sensor node is a general sensor node 120, at step S731, the sensor node transmits the received data to an adjacent general sensor node 120 or an adjacent sensor and data processing node 130.

Meanwhile, when the type of the sensor node is a sensor and data processing node 130, at step S732, the sensor node processes the data to calculate the amount of accumulation and the frequency number of occurrence based on the characteristics of the sensor and an application field and, at step S740, the sensor node determines whether the current circumstances are emergency or not based on the data processing result. In short, the sensor node compares the accumulation amount and the occurrence frequency number of the sense data it has received for a predetermined period and the sense data it has sensed, created and transmitted with a predetermined threshold corresponding to the kind of sense data, and determines that the current circumstances are emergency when the accumulation amount and the occurrence frequency number exceed the threshold.

When the sensor node does not determine that the current circumstances are emergency, at step S741, the sensor node transmits the received data to the adjacent general sensor node 120 or a sensor and data processing node 130. When it determines that the current circumstances are emergency, at step S742, it creases emergency data packets including disaster occurrence information and, at step S743, it urgently transmits the emergency data packets to the actuator node 140 and/or the gateway node 150.

The above procedure may be described in general as follows.

Among the received data, emergency data which notify that the circumstances are serious and emergency are transmitted to the actuator node 140 and/or the gateway node 150 through the adjacent general sensor node 120 or sensor and data processing node 130.

In case where the received data are not emergency data, it is determined whether the sensor node is a general sensor node 120 or a sensor and data processing node 130. When the sensor node is a general sensor node 120, the sensor node transmits the received data to an adjacent general sensor node 120 or an adjacent sensor and data processing node 130. When the sensor node is a sensor and data processing node 130, the sensor node processes the received data based on the accumulation amount, the occurrence frequency number, and other processing algorithms according to the application field and sensor characteristics, and determines whether a disaster occurs or not. When the circumstances are disastrous, the sensor node creates emergency data, which is a message for informing the occurrence of disaster, and transmits the emergency data to the actuator node 140 and/or the gateway node 150 directly or through an adjacent general sensor node 120 or an adjacent sensor and data processing node 130. When the circumstances are not disastrous, the sensor node abandons the received data or creates data packet and transmits the data packet to an adjacent general sensor node 120 and/or an adjacent sensor and data processing node 130. The data transmitted from the sensor node are significant data, that is, data whose sense value exceeds a predetermined threshold that corresponds to the kind of the sense data.

The method of the present invention can quickly determine a dangerous factor in individual nodes set up in a dangerous area can, compared to a method of determining a dangerous factor in a central server, when a disaster such as fire, flood and earthquake has occurred. The quick sense of danger alerts the surroundings rapidly and, if necessary, the danger alert can be delivered to an administrator or a related system. Since a danger factor is determined not in a system but in a plurality of devices, the reliability and immediacy of disaster circumstantial information can be improved.

The present application contains subject matter related to Korean patent application Nos. 2005-107045 and 2006-61223, filed with the Korean Intellectual Property Office on Nov. 9, 2005, and Jun. 30, 2006, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A distributional alert system using a ubiquitous sensor network (USN), comprising:

a first sensor node for generating sense data by sensing surroundings with a sensor therein, determining whether a disaster occurs by analyzing the sense data when an accumulation amount and an occurrence frequency number of the sense data which is received for a predetermined period is found to exceed a predetermined threshold, and creating and transmitting emergency data based on the determination result, while forming a sensor network; and an alerting node for receiving emergency data from the first sensor node on the sensor network, and outputting disaster circumstantial information to a sensor field of the sensor network upon receipt of the emergency data.

2. The system as recited in claim 1, further comprising:

a second sensor node for transmitting the sense data when a sense value obtained by sensing the surroundings with the sensor exceeds the predetermined threshold.

3. The system as recited in claim 2, wherein the first sensor node receives the sense data and, when a sense value of the received sense data exceeds the predetermined threshold, creates and transmits the emergency data.

4. The system as recited in claim 1, further comprising:

a gateway node for receiving the emergency data and transmitting the emergency data to an external communication network.

5. The system as recited in claim 1, wherein the first sensor node includes:

a communication module for wirelessly communicating with adjacent network nodes;

a routing module for searching locations of the adjacent network nodes and setting up a communication route;

a sensor module for sensing a physical environment of the surroundings, converting sensed physical dimensions into digital signals, and outputting sense data;

a power management module for providing and controlling a power source;

a data processing module for determining whether a disaster occurs by processing the sense data and creating emergency data based on the determination result; and a controlling module for generally controlling the above constituent elements.

6. The system as recited in claim 1, wherein the alerting node includes:

a communication module for wirelessly communicating with adjacent network nodes; and a data processing module for outputting alert signals to actuate an alerting apparatus based on the received emergency data.

7. The system as recited in claim 4, wherein the gateway node includes:

a first communication module for wirelessly communicating with network nodes on the sensor network;

a second communication module for communicating with a device out of the sensor network; and an inter-networking module for connecting the first communication module and the second communication module.

8. A distributional alert system using a ubiquitous sensor network (USN), comprising:

a plurality of sensor nodes for sensing surroundings with a sensor therein, creating and transmitting sense data, and forming a sensor network; and a non-sensor alerting node for receiving the sense data from the sensor nodes, determining whether a disaster occurs by analyzing and processing the received sense data when an accumulation amount and an occurrence frequency number of the sense data which is received for a predetermined period is found to exceed a predetermined threshold, and when the disaster occurs, outputting disaster circumstantial information to a sensor field of the sensor network.

9. The system as recited in claim 1, wherein the sensor nodes transmit the sense data when a sense value obtained by sensing the surroundings exceeds a predetermined threshold.

10. The system as recited in claim 1, wherein the alerting node creates and transmits emergency data when a sense value of the received sense data exceeds a predetermined threshold.

11. The system as recited in claim 10, further comprising:

a gateway node for receiving the emergency data and transmitting the emergency data to an external communication network.

12. The system as recited in claim 8, wherein each of the sensor nodes includes:

a communication module for wirelessly communicating with adjacent network nodes;

a routing module for searching locations of the adjacent network nodes and setting up a communication route;

a sensor module for sensing a physical environment of the surroundings, converting sensed physical dimensions into digital signals, and outputting sense data;

a power management module for providing and controlling a power source; and a controlling module for generally controlling the above constituent elements.

13. The system as recited in claim 8, wherein the altering node includes:

a communication module for wirelessly communicating with the adjacent network nodes; and a data processing module for determining whether a disaster occurs by processing the received sense data, creating emergency data based on the determination result, and actuating an alerting apparatus.

14. A distributional alert system using a ubiquitous sensor network (USN), comprising:

a first sensor node for generating and transmitting sense data by sensing surroundings with a sensor therein; and a second sensor node for forming a sensor network together with the first sensor node, receiving the sense data, determining whether a disaster occurs by analyzing the sense data when an accumulation amount and an occurrence frequency number of the sense data which is received for a predetermined period is found to exceed a predetermined threshold, and creating and transmitting emergency data; and an alerting node for receiving the emergency data, and outputting disaster circumstantial information to a sensor field of the sensor network upon receipt of the emergency data.

15. The system as recited in claim 14, further comprising:

a gateway node for receiving the emergency data and transmitting the emergency data to an external communication network out of the sensor network.

* * * * *